United States Patent [19]

Simonds, Jr.

[11] 4,012,175

[45] Mar. 15, 1977

[54] VALVE AND PUMP CONTROL FOR A HYDRAULIC SYSTEM

[75] Inventor: George D. Simonds, Jr., Mequon, Wis.

[73] Assignee: Douglas Dynamics Corporation, Milwaukee, Wis.

[22] Filed: Dec. 31, 1975

[21] Appl. No.: 645,516

[52] U.S. Cl. ..... 417/316; 60/433; 60/470; 37/DIG. 7

[51] Int. Cl.[2] ..... F04B 9/00

[58] Field of Search ..... 417/316, 317, 1; 60/434, 470, 433; 37/DIG. 7

[56] References Cited

UNITED STATES PATENTS

| | | | |
|---|---|---|---|
| 1,231,613 | 7/1917 | James | 417/316 |
| 2,219,359 | 10/1940 | Goit et al. | 417/316 |
| 2,746,251 | 5/1956 | Ashton | 60/434 |
| 2,956,728 | 10/1960 | Goepfrich et al. | 417/316 |
| 3,036,433 | 5/1962 | Loup | 60/470 |
| 3,443,380 | 5/1969 | Karazija | 60/434 |
| 3,630,025 | 6/1970 | Henry | 60/434 |
| 3,945,768 | 3/1976 | Georgi | 417/317 |

*Primary Examiner*—Carlton R. Croyle
*Assistant Examiner*—G. P. LaPointe

[57] ABSTRACT

The operation of a 4-way, open-center, three position hydraulic valve is coordinated with the operation of the pump for the hydraulic system in which the valve is controlling flow. As the valve is moving from its open-center position to either one of its other two operative positions, a switch maintains the power circuit for the pump open and closes that circuit to activate the pump after the valve has assumed one of the other two positions.

11 Claims, 3 Drawing Figures

VALVE AND PUMP CONTROL FOR A HYDRAULIC SYSTEM

BACKGROUND OF THE INVENTION

This invention relates to control arrangements for hydraulic systems and, more particularly, to such control arrangements as are used to achieve lifting and/or angling of a vehicle mounted snowplow blade.

It is well known to control the hydraulic circuit of a vehicle mounted snowplow blade with a 4-way, open-center, three position valve. The operation of such valves has been controlled through, for example, the use of bowden wires and also with the use of solenoid actuators. The objectives sought in such systems are compactness of the basic operating elements and to minimize the amount of hydraulic tubing and control lines (mechanical and electrical) required, all consistent with effective and reliable operation. In this regard, there has been a growing tendency toward the use of solenoid actuators and away from bowden wires.

This invention is concerned with this general area and has among its general objects to simplify the valve arrangement of the hydraulic system and permit the use of relatively small and yet effective solenoid units in the valve actuator.

SUMMARY OF THE INVENTION

For the achievement of these and other objects, this invention proposes generally unitary assembly which achieves both valve control over the flow of hydraulic fluid in a system and also control over the pump developing the fluid pressure to achieve that flow. In this respect, a switch is included in the power circuit for the pump and is associated with the actuator for achieving control valve movement such that the pump is deactivated while the valve is moving from one operative position to another and is activated after the valve has assumed the intended operative position. Accordingly, the valve member moves before the pump applies pressure to the fluid system so that smaller actuating forces are involved and a smaller valve actuator can be used thereby permitting a reduction in the overall size of the valve assembly.

To contribute further to the compactness of the unit, the valve actuators are connected to and supported from the body of the valve. The actuators directly engage shaft extensions which are connected to the movable valve member and through which motion is transmitted to that valve member to achieve the various operative valve positions. This places the basic control elements for the hydraulic system in a single, unitary package.

Other objects and advantages will be pointed out in, or be apparent from, the specification and claims, as will obvious modifications of the embodiment shown in the drawings, in which:

DESCRIPTION OF THE PREFERRED EMBODIMENT

Figure 2:
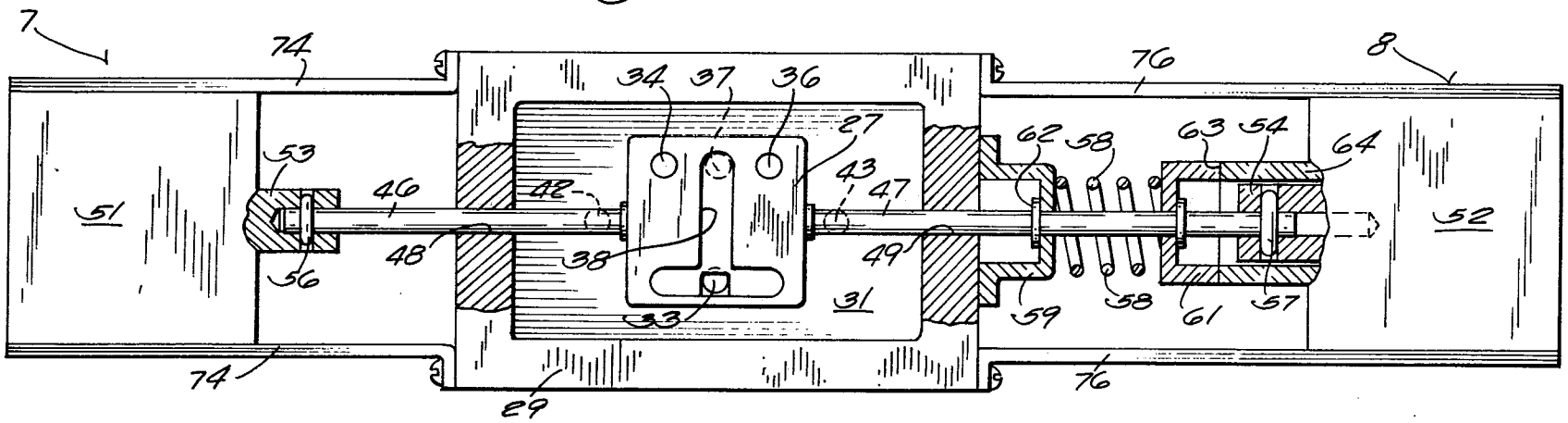
FIG. 2 is a top plan view, with parts broken away, of a valve-pump control embodying this invention.

With particular reference to the drawing, a snowplow blade 1 is supported in a conventional manner from a vehicle (not shown) and can be angled to the right or left by actuation of hydraulic cylinders 2 or 3 and can be raised and lowered by operation of hydraulic cylinder 4. Selection of the direction of angulation and raise and lower is controlled through a 4-way, closed-center, three position valve 6. The operative state of valve 6 is controlled by solenoid units 7 and 8, in a manner to be described more completely hereinafter, and hydraulic fluid is channeled to the cylinders through conduits 9, 11, and 12 communicating with ports in the valve. To complete the hydraulic system, a reservoir 13 for the hydraulic fluid is connected to valve 6 through conduit 14, and return flow from cylinders 2 and 3 is through the valve and conduit 14. Return flow from lift cylinder 4 to reservoir 13 is through a conduit 16 controlled by valve 17 separate from valve 6. Hydraulic fluid is caused to flow from reservoir 13 under pressure to valve 6 through conduits 18 and 19 by pump 21. Pump 21 is driven by an electric motor 22, the electric motor being energized from the vehicle battery 23 through an electric circuit 24 which will be described more completely hereinafter.

The structure and operation of valve 6 are more completely described, and claimed, in the co-pending application of Jack C. Hill filed Dec. 31, 1975, Ser. No. 645513, entitled Valve and assigned to the assignee of this application. A general description of the valve will be made for the purposes of understanding this invention and reliance is placed on the just mentioned co-pending application should a more complete description be required.

Valve 6 includes a manifold 26, a slide valve member 27, a cover plate 28, and a ring 29. The manifold, cover plate, and ring cooperate to define an inner, generally fluid-tight chamber 31 in which valve member 27 is movable relative to a plurality of ports in manifold 26. The manifold, cover plate, and ring are held in assembled relationship by bolts 32.

The ports in manifold 26 consist of a pump port 33 connected to conduit 19, a first angle port 34 connected to conduit 9, a second angle port 36 connected to conduit 12 and a lift port 37 connected to conduit 11. An inverted "T" shaped slot 38 is provided in face 39 of valve member 27. The valve member can assume one of three positions, that illustrated in FIG. 2 wherein the vertical leg of the T-slot registers with port 37 and second and third positions wherein the vertical leg registers with ports 34 and 36. In all three of these operative positions of the valve member, the horizontal portion of the T-slot registers with pump port 33 so that fluid communication is maintained, through the T-slot, between the pump port and a selective one of the ports 34, 36, and 37 depending on the operative state of the actuator units for the valve.

Figure 3:
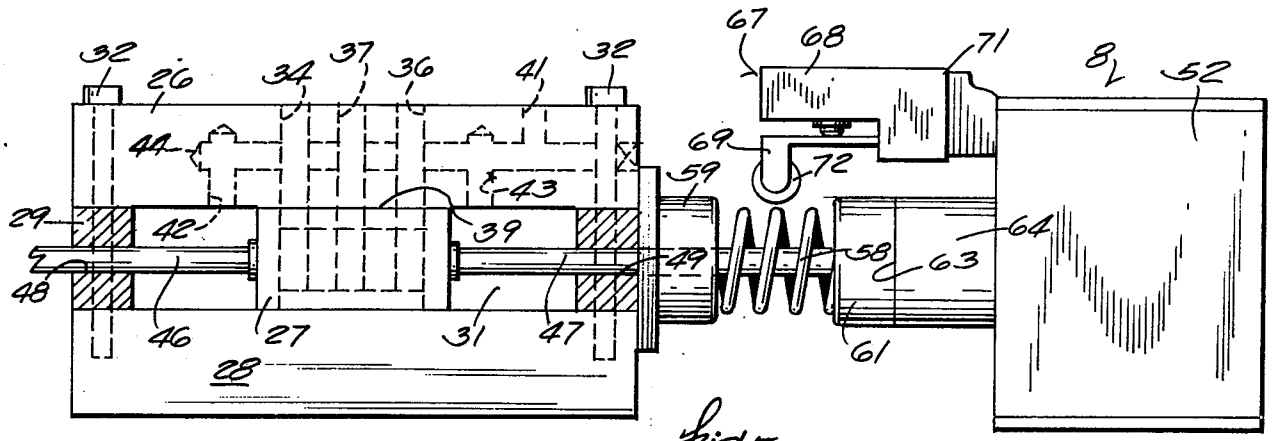
FIG. 3 is a side elevation of a portion of the arrangement of FIG. 2, again with portions broken away to better illustrate the operative elements of the control.
Figure 1:
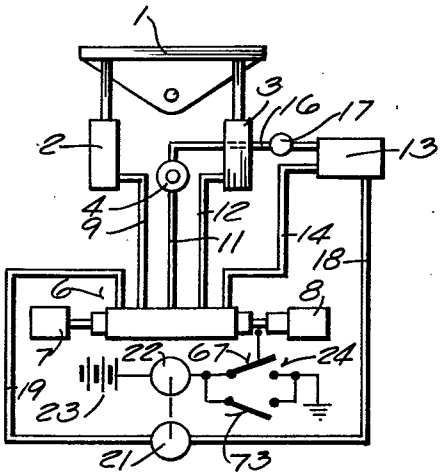
FIG. 1 is a schematic view of a hydraulic system for a vehicle mounted snowplow blade.

A tank port 41 is provided in the manifold and is connected to reservoir 13 by conduit 14. The tank port communicates with chamber 31 through one of two ports 42 and 43 which open into chamber 31 as is best illustrated in FIG. 3. Ports 42 and 43 are connected by a through channel 44. In operation, port 42 is closed to chamber 31 when vertical portion 38 of the T-slot registers with angle port 34 leaving angle port 36 open to chamber 31 to communicate with the reservoir 13 through port 43 so that as cylinder 2 is activated hydraulic fluid in cylinder 3 can return through that circuit to the reservoir. Similarly, when vertical portion 38 of T-slot registers with port 36, tank port 43 is closed to chamber 31, tank port 42 remains open and angle port 34 is open to chamber 31 so that as cylinder 3 is operated by introduction of hydraulic fluid, hydraulic fluid can return from cylinder 2 through that circuit to reservoir 13.

As mentioned above, the return path for hydraulic fluid from lift cylinder 4 to tank 13 is through a conduit 16 external of the main valve and is controlled by a secondary valve 17.

With the above general description of the hydraulic circuit, the actuator, and the manner in which it coordinates with the pump drive, will be described.

A shaft is connected to valve member 27 to transmit motion to that valve member whereby it can assume one of the three operative positions mentioned above. The shaft consists of two portions 46 and 47, each attached to the valve member. The shaft portions are axially aligned and project from opposite sides of the valve member and, through aligned openings 48 and 49 in ring 29, exteriorly of the valve body. Actuating units 7 and 8 are in the form of solenoids of generally conventional construction consisting of coil and armature assemblies 51 and 52. Armatures 53 and 54 project toward valve 6 and are connected to shaft portions 46 and 47 respectively. This connection is made in any conventional manner such as pins 56 and 57. In a conventional and well known manner, when solenoids 51 or 52 are electrically energized armatures 53 and 54 will move in response to that energization. With the just described structure, it will be appreciated that as the armatures move, the shaft portions 46 and 47 also move and correspondingly so does valve member 27.

To establish the basic position of the valve and the actuating elements illustrated in FIG. 2 to set up the lift mode of operation for the system, a spring arrangement is directly associated with the shaft through which motion is transmitted to valve member 27. More specifically, compression spring 58 surrounds a portion of shaft 47. The compression spring is positioned between two spring abutments 59 and 61. Spring abutment 59 engages the valve body defined by the manifold ring and cap and is associated with a stop ring 62 connected to shaft portion 47. Similarly, abutment 61 engages a shoulder 63 provided on a projection 64 which is part of solenoid assembly 52. A stop ring 66 is connected to and movable with shaft 47. As can be seen in FIG. 2, activation of solenoid 51 will move shafts 46 and 47 and slide 27 to the left also moving abutment 61 to the left and compressing spring 58 against abutment 59 which is held against movement by ring 29. Energization of solenoid 51 positions the vertical portion of T-slot 38 in registry with port 34. When the solenoid is subsequently de-energized, compression spring 58 returns abutment 61 to engagement with shoulder 63 re-establishing the position of FIG. 2.

Similarly, when solenoid 52 is energized, shafts 46 and 47 and correspondingly valve member 27, are moved to the right to register the T-slot vertical portion with port 36. This moves abutment 59 away from engagement the valve body compressing the spring 58. When solenoid 52 is subsequently de-energized, spring 58 returns abutment 59 to engagement with the valve body re-establishing the position of the T-slot in registry with port 37.

It should be noted at this point that, since the manifold has been removed in FIG. 2 the ports formed would not be visible in that view. For purposes of illustration, those ports have been included by the dotted line representation.

In order to coordinate valve and pump operation and to utilize the motion of the valve member shaft to achieve that coordination, a switch assembly 67 is associated with solenoid actuator 52. Switch assembly 67 includes a miniature switch 68 and a switch actuator 69. The miniature switch is connected to solenoid unit 52 by mounting bracket 71. Actuator 69 includes a roller 72 positioned in the path of movement of abutments 59 and 61. Switch 68 is a normally open switch and when in the position illustrated in FIG. 3, which corresponds to the valve orientation of FIG. 2, the circuit to pump motor 22 is open and the pump is not energized. When either solenoid unit 51 or 52 is energized, the respective one of abutments 59 and 61 move into engagement with roller 72 closing switch 67 after valve member 27 has assumed the operative position wherein the vertical portion of T-slot 38 registers with either port 34 or 36. Thus, after the operative position of the valve has been established, the circuit to pump motor 22 is completed, the pump started and pressure applied in the hydraulic line.

In the preferred embodiment wherein an operative function is to be accomplished when the valve member 27 is in its central position of FIG. 2, an override switch 73 is provided and is separately actuated to complete the circuit to pump motor 22 and supply fluid under pressure to lift cylinder 4.

With the just described electrical circuitry, it will be noted that the pump motor is not energized until valve member 27 has assumed one of its three operative positions. Therefore, when the valve member is called upon to move between those operative positions, the fluid in the system is not under pressure due to the influence of pump 21 and lesser forces are involved. This permits smaller, more economical solenoids to be utilized in the actuator contributing both to the overall compactness and economy of the control.

In addition, it will be noted that solenoids 51 and 52 are connected directly to and supported from the valve body by brackets 74 and 76, making for an overall compact, integrated, unitary assembly which provides the valving for the basic hydraulic circuit as well as the electrical control for the pump motor.

Although this invention has been illustrated and described in connection with a particular embodiment thereof, it will be apparent to those skilled in the art that various changes and modifications may be made therein without departing from the spirit of the invention or from the scope of the appended claims.

I claim:

1. A combination valve, valve actuator and pump control for use in a hydraulic system wherein said valve is manipulated by said valve actuator to control flow in said hydraulic system and a pump is controlled by said pump control to produce flow in said hydraulic system and wherein said valve includes a body, a valve member in said body movable between first, second and third positions, means defining a plurality of flow ports in said body operatively associated with said valve member so that as said valve member assumes said first, second and third positions fluid flow circuits are established through said valve, and shaft means connected to said valve member for transmitting movement to said valve means, said shaft means projecting exteriorly of said body;

said valve actuator including operating means engaging said shaft means and having first, second and third states of operation corresponding to said first, second and third valve member positions;

said pump control includes switch means in the circuit for said pump means to alternately activate and deactivate said pump means circuit;

and means connecting said operating means directly to said shaft means and including switch actuating means assuming positions relative to said switch means in accordance with whether said operating means is in said first, second or third states of operation, in said first state of operation said switch means deactivating the circuit to said pump means and activating the circuit to said pump means when said operating means is in said second and third states of operation and after said valve member has moved to said second and third positions.

2. The combination of claim 1 wherein said shaft means comprises first and second axially aligned portions projecting oppositely from said valve member and both extending exteriorly of said body;

said operating means includes selectively activated first and second units one directly engaging a respective one of said first and second shaft means portions and also includes biasing means connected to said shaft means for positioning said shaft means to position said valve member in said first position when both said first and second units are deactivated and selective actuation of said first and second units moving said valve member against said bias to said second and third positions respectively.

3. The combination of claim 2 wherein said first and second units are connected to and supported on said valve body.

4. The combination of claim 2 wherein said biasing means comprises a spring positioned on said first shaft means portion, including spaced spring abutments connected to and movable with said shaft means and arranged with said spring positioned therebetween, including stop means adjacent each spring abutment engaging and holding said abutment against movement in one direction and allowing said one spring abutment to move freely in the opposite direction so that movement of said shaft means in one direction is against said spring through one abutment and in an opposite direction is against said spring through the other abutment, and wherein when said first and second units are deactivated said spring positions said valve member in said first position and movement produced by activation of said first and second units is against said spring.

5. The combination of claim 4 wherein said abutments are spaced from said switch means when said first and second units are deactivated and said switch means is open and said abutments engage and close said switch means when said first and second units have been activated and after said valve member has been moved to said second and third positions.

6. The combination of claim 5 wherein said hydraulic system is for raising and angling a snowplow blade and includes a lift hydraulic cylinder and first and second angling hydraulic cylinders, and in said first position said valve member establishes a circuit to said lift cylinder closing the hydraulic circuits to said angling cylinders and in said second and third positions said valve member establishes circuits to respective ones of said angling cylinders while closing the circuit to said lift cylinder.

7. The combination of claim 3 wherein said hydraulic system is for raising and angling a snowplow blade and includes a lift hydraulic cylinder and first and second angling hydraulic cylinders, and in said first position said valve member establishes a circuit to said lift cylinder closing the hydraulic circuits to said angling cylinders and in said second and third positions said valve member establishes circuits to respective ones of said angling cylinders while closing the circuit to said lift cylinder.

8. The combination of claim 6 wherein said units are electric solenoids.

9. The combination of claim 3 wherein said units are electric solenoids.

10. A combination valve, valve actuator and pump control for use in a hydraulic system wherein said valve is manipulated by said valve actuator to control flow in said hydraulic system and a pump is controlled by said pump control to produce flow in said hydraulic system and wherein said valve includes a body, means defining at least two flow ports in said body, a valve member movable in said valve body relative to said flow ports to selectively open and close said ports to fluid flow, and shaft means connected to said valve member for transmitting movement to said valve means, said shaft means projecting exteriorly of said body;

said valve actuator including operating means for producing said valve member movement;

said pump control switches means in the circuit for said pump means to alternately activate and deactivate said pump means circuit;

and means connecting said operating means directly to said shaft means and including switch actuating means operatively associated with said switch means to maintain said switch means in a state whereby said pump means circuit is deactivated when said valve member is in one position relative to said ports and to establish a second state of said switch means activating said pump means circuit after said valve member has moved from said one position relative to said ports to a second position relative to said ports.

11. The combination of claim 10 wherein said operating means is connected to and supported on said valve body.

* * * * *